US006805140B2

(12) United States Patent
Velez, Jr. et al.

(10) Patent No.: US 6,805,140 B2
(45) Date of Patent: Oct. 19, 2004

(54) APPARATUS AND METHOD FOR CLEANING AIRFOIL INTERNAL CAVITIES

(75) Inventors: Ramon M. Velez, Jr., Windsor, CT (US); Peter J. Draghi, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/271,681

(22) Filed: Oct. 15, 2002

(65) Prior Publication Data

US 2004/0069324 A1 Apr. 15, 2004

(51) Int. Cl.[7] ..... B08B 9/00

(52) U.S. Cl. ..... 134/22.1; 134/166 R; 134/171; 134/198

(58) Field of Search ..... 134/22.1, 22.12, 134/22.18, 166 R, 169 R, 171, 198

(56) References Cited

U.S. PATENT DOCUMENTS 1,492,905 A * 5/1924 Swanick ..... 134/5
2,737,192 A 3/1956 Bieler
5,464,479 A * 11/1995 Kenton et al. ..... 134/1
5,507,306 A * 4/1996 Irvine et al. ..... 134/166 R
5,679,174 A * 10/1997 Buongiorno ..... 134/22.18
5,707,453 A * 1/1998 Shurman et al. ..... 134/1

* cited by examiner

*Primary Examiner*—Michael Barr
*Assistant Examiner*—Saeed Chaudhry
(74) *Attorney, Agent, or Firm*—Bachman & LaPointe, P.C.

(57) ABSTRACT

The present invention relates to a method and a device for cleaning internal passageways within a component, such as a component to be used in an engine. The device for cleaning the internal passageway includes a first probe having a longitudinal axis and at least one nozzle oriented at an angle, preferably perpendicular, to the longitudinal axis. In a preferred embodiment, the first probe has two nozzles, both oriented perpendicular to the longitudinal axis, and offset 180 degrees from each other. The device further includes a second probe having a longitudinal axis and a nozzle in a tip end, which nozzle is oriented along the longitudinal axis. Preferably, the first and second probes are connected to a common manifold.

8 Claims, 2 Drawing Sheets

APPARATUS AND METHOD FOR CLEANING AIRFOIL INTERNAL CAVITIES

BACKGROUND OF THE INVENTION

The present invention relates to a device and a method for cleaning internal cavities within an airfoil portion of an engine component.

Current processes for internally cleaning engine components having internal passageways involves the use of an autoclave process and a high pressure wash. The high pressure wash uses a manifold with probes introduced into a corresponding number of root openings of the internal passageways being cleaned. High pressure water is then pumped through the manifold and the probes. Depending on the configuration of the internal passageways, as shown in FIG. 1, this can create turbulence at locations 10 and 12, thus reducing the free flow. The internal flow of the high pressure wash also misses a "dead zone" area 14 which can not be cleaned effectively. This is due in large part to the fact that each of the probes has a nozzle at its tip.

SUMMARY OF THE INVENTION

Accordingly, it is an object of the present invention to provide an improved method for cleaning the internal passageways of a component.

It is a further object of the present invention to provide an improved device for cleaning the internal passageways of a component.

The foregoing objects are attained by the method and the device of the present invention.

In accordance with the present invention, a method for cleaning the internal passageways of a component, such as an engine component, is provided. The method broadly comprises the steps of providing a device having a first means for dispensing a cleaning fluid, which device has a longitudinal axis and at least one nozzle oriented perpendicular to the longitudinal axis, inserting the first dispensing means into a first internal passageway, and dispensing a cleaning fluid through the at least one nozzle at a pressure sufficient to clean surfaces of the first internal passageway.

A device for cleaning the internal passageways of a component is also provided. The device broadly comprises a first means for dispensing a cleaning fluid which extends into a first passageway. The first cleaning fluid dispensing means has a longitudinal axis and at least one nozzle through which said cleaning fluid is dispensed. The at least one nozzle is oriented perpendicular to the longitudinal axis.

Other details of the apparatus and the method for cleaning airfoil internal cavities, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 2:
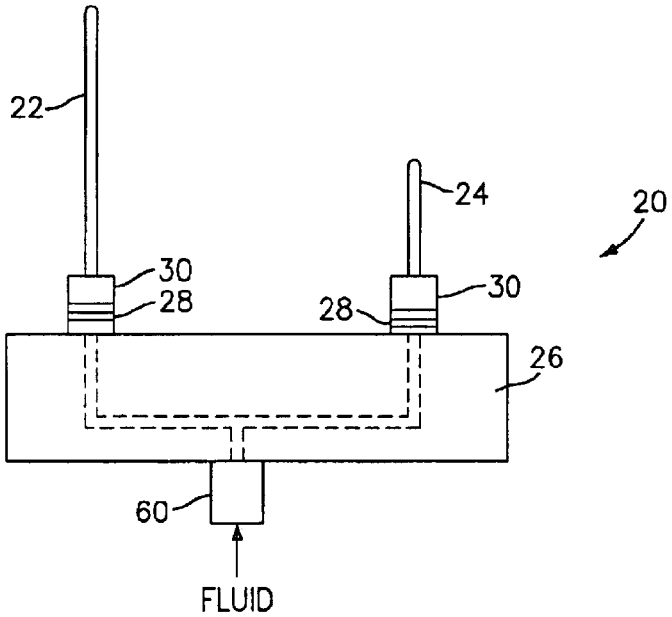
FIG. 2 illustrates a device for cleaning internal passageways within a component in accordance with the present invention.

Referring now to the drawings, FIG. 2 illustrates a device 20 for cleaning internal cavities within a component, such as a component to be used in an engine such as a jet engine or an industrial turbine engine. The component may be a blade or a vane to be used in the engine. Such components typically have a root portion and an airfoil portion. Within the root portion and the airfoil portion are internal cooling passageways which require cleaning.

As shown in FIG. 2, the device 20 includes a first probe 22, a second probe 24, and a manifold 26. The first probe 22 and the second probe 24 may be formed from any suitable material known in the art such as metallic materials used for syringe needles. Each of the first and second probes 22 and 24 may be connected to the manifold 26 by any suitable means known in the art. For example, each of the probes 22 and 24 may be connected to the manifold 26 by an externally threaded member 28 integrally formed on the manifold 26 and a compression nut 30 joined to the respective probe and having an internal thread for mating with the external thread of the member 28. Alternatively, each of the probes 22 and 24 may be welded to the manifold 26 or integrally formed with the manifold 26.

Figure 1:
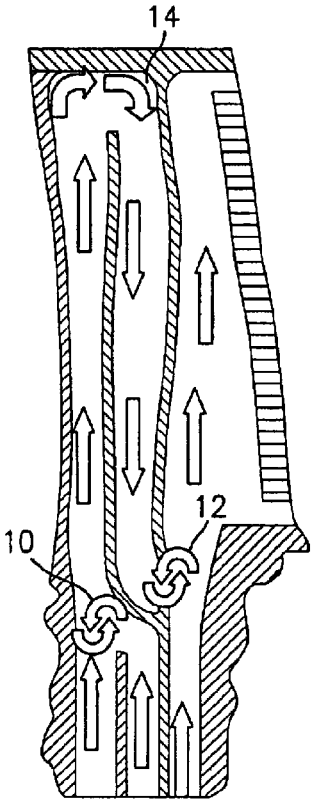
FIG. 1 (PRIOR ART)
FIG. 1 is a schematic illustration of a prior art system for cleaning internal cavities of an airfoil.
Figure 6:
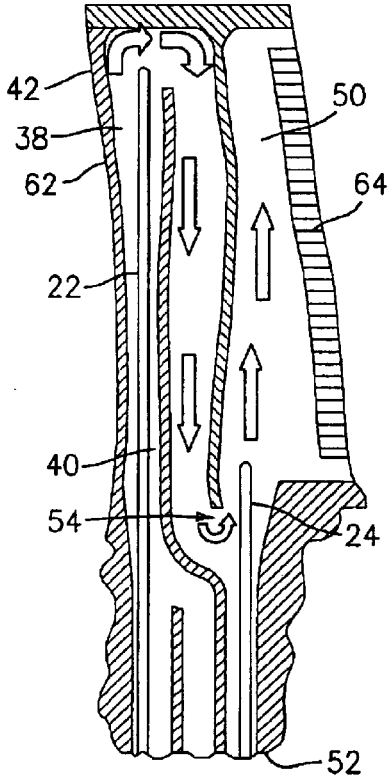
FIG. 6 is a schematic illustration of the device for cleaning internal passageways in use.
Figure 3:
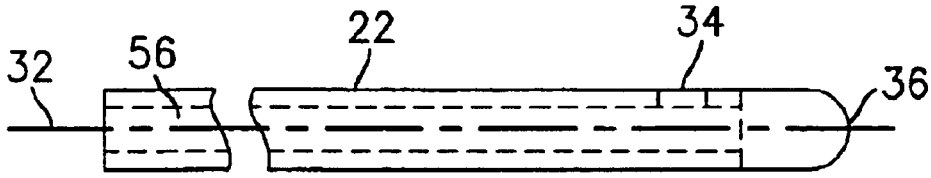
FIG. 3 illustrates a first embodiment of a first probe used in the device of FIG. 2.

Referring now to FIG. 3, the first probe 22 may have a first longitudinal axis 32 and at least one nozzle 34 adjacent a closed tip end 36 of the probe. Each nozzle 34 is oriented at an angle to longitudinal axis 32, preferably substantially perpendicular to longitudinal axis 32, most preferably perpendicular to the longitudinal axis 32. As shown in FIG. 6, the first probe 22 has a length sufficient to place it in close proximity, preferably within 0.025 inches, to an end wall 38 of a first internal passageway 40 within a component 42 to be cleaned.

Figure 4:
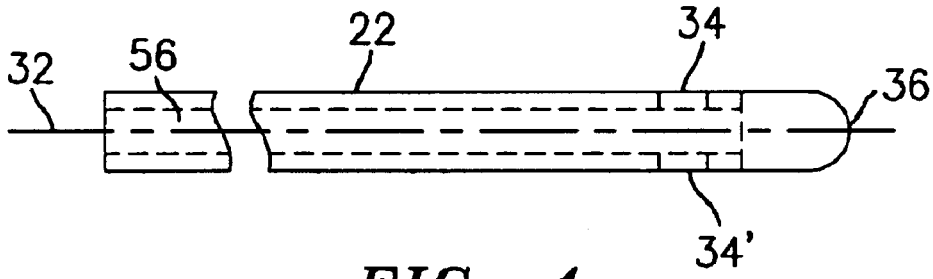
FIG. 4 illustrates a second embodiment of a first probe used in the device of FIG. 2.

FIG. 4 illustrates an alternative embodiment of the first probe 22. In this embodiment, the probe 22 has two nozzles 34 and 34'. Both nozzles 34 and 34' are oriented substantially perpendicular, preferably perpendicular, to the longitudinal axis 32. Further, the nozzles 34 and 34' are offset by 180 degrees.

Figure 5:
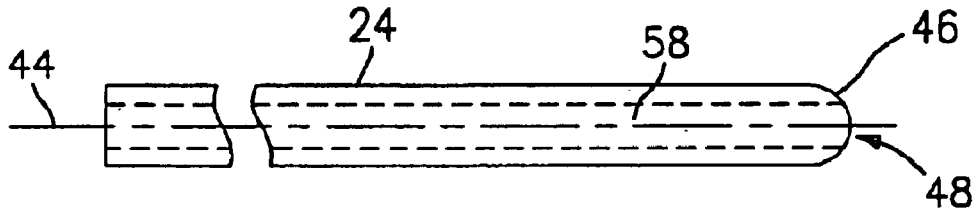
FIG. 5 illustrates a second probe used in the device of FIG. 2.

FIG. 5 illustrates the second probe 24. As can be seen from this figure, the second probe 24 has a second longitudinal axis 44, a tip end 46 and a nozzle 48. The nozzle 48 is preferably oriented along the longitudinal axis 44 to dispense a cleaning fluid into a second internal passageway 50. The second probe 24 has a length shorter than the length of the first probe 22. The length of the second probe 24 however should be greater than a distance from the root portion 52 of the component 42 to a point where the second internal passageway 50 intersects an outlet 54 of the first passageway 40 to avoid the creation of unwanted turbulence and to create a suction effect which draws cleaning fluid exiting the outlet 54 into the passageway 50.

While not shown in the drawings, the manifold 26 has internal passageways which communicate with the internal passageways 56 and 58 of probes 22 and 24 respectively. The manifold 26 also has a fluid inlet 60 through which the manifold 26 can be connected to a source of cleaning fluid (not shown). The cleaning fluid may be water or water mixed with a cleaning agent.

Referring now to FIG. 6, the internal passageways 40 and 50 may be cleaned by inserting the first and second probes 22 and 24 into the passageways 40 and 50 respectively through openings in the root portion 52. The internal passageway 40 is preferably the internal passageway closest to a leading edge 62 of the component 42, while the internal passageway 50 is preferably the internal passageway closes to a trailing edge 64 of the component 42. After the probes 22 and 24 have been inserted into the passageways 40 and 50, cleaning fluid at a pressure sufficient to clean internal surfaces of the passageways 40 and 50 is dispensed through the nozzles 34 and/or 34' and 48. In a preferred method of the present invention, the cleaning fluid is dispensed at a pressure in the range of 1.5 Ksi and 10.0 Ksi.

It has been found that the method of the present invention substantially avoids the creation of unwanted turbulence in the passageways 40 and 50 which turbulence interferes with the cleaning operation. Further, it has been found that the fluid dispensed through the nozzles 34 and/or 34' flows into all areas of the passageway 40. As a result, there are no "dead zones". This is because the fluid exiting the nozzles 34 and/or 34' fans out within the internal passageway 40.

While cleaning may be performed using only the high pressure wash method described above, for certain components, it may be desirable to subject the component to an ultrasonic cleaning cycle prior to insertion of the probes 22 and 24. The ultrasonic cleaning cycle may be formed in any suitable manner known in the art using any suitable cleaning solution known in the art, such as an alkaline rust remover solution or an aqueous degreaser solution. Preferably, the ultrasonic cleaning cycle is performed for a time period in the range of 1.0 hour to 2.0 hours at a frequency in the range of 20 KHz to 104 KHz.

It is apparent that there has been provided in accordance with the present invention a method and apparatus for cleaning airfoil internal cavities which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations which fall within the broad scope of the appended claims.

What is claimed is:

1. A device for cleaning internal passageways in an airfoil portion of an engine component, said device comprising:

a first probe extending into a first internal passageway closest to a leading edge of said airfoil portion;

a second probe extending into a second internal passageway closest to a trailing edge of said airfoil component;

said first probe having a first longitudinal axis and at least one nozzle perpendicular to said first longitudinal axis.

2. A device according to claim 1, further comprising said first probe having two nozzles offset by 180 degrees.

3. A device according to claim 2, wherein each of said nozzles is oriented perpendicular to the first longitudinal axis.

4. A device according to claim 1, further comprising said passageway closest to said leading edge having an outlet which intersects said passageway closest to said trailing edge and said second probe having a length greater than a distance from a root portion of the airfoil to the intersection of said outlet and said passageway closest to the trailing edge in order to prevent the creation of turbulence.

5. A device according to claim 4, wherein said first probe has a length greater than the length of the second probe.

6. A device according to claim 1, wherein said second probe has a tip end and a nozzle in said tip end and said nozzle in said second probe being oriented along a longitudinal axis of said second probe.

7. A device according to claim 1, further comprising said first and second probe being connected to a common manifold.

8. A method for cleaning internal passageways within a turbine engine component, the method comprising the steps of:

providing a device having a first means for dispensing a cleaning fluid, which device has a longitudinal axis and at least one nozzle oriented substantially perpendicular to said longitudinal axis;

inserting said first means into a first internal passageway via an opening in a root portion of said turbine engine component;

dispensing a cleaning fluid through said at least one nozzle at a pressure sufficient to clean surfaces of said first internal passageway;

said device providing step comprising providing a device having a second means for dispensing said cleaning fluid, which second dispensing means has a longitudinal axis, a tip end, and a nozzle in said tip end oriented along said longitudinal axis of said second dispensing means;

inserting said second dispensing means into a second internal passageway;

dispensing said cleaning fluid through said nozzle in said second dispensing means at said pressure sufficient to clean internal surfaces of said second internal passageway;

said step of inserting said first dispensing means comprising inserting said first dispensing means into an internal passageway closest to a leading edge of said component; and said step of inserting said second dispensing means comprising inserting said second dispensing means into an internal passageway near a trailing edge of said component.

* * * * *